US007793891B2

(12) United States Patent
Hein et al.

(10) Patent No.: US 7,793,891 B2
(45) Date of Patent: Sep. 14, 2010

(54) RAILWAY DIAMOND CROSSING

(75) Inventors: Russell R. Hein, Denison, TX (US); Robert C. Roberts, Jr., Talladega, AL (US); Brian Weaver, Burlington, KY (US)

(73) Assignee: Progress Rail Services Corp., Albertville, AL (US)

( * ) Notice: Subject to any disclaimer, the term of this patent is extended or adjusted under 35 U.S.C. 154(b) by 194 days.

(21) Appl. No.: 11/696,762

(22) Filed: Apr. 5, 2007

(65) Prior Publication Data

US 2008/0245931 A1 Oct. 9, 2008

(51) Int. Cl.
*E01B 7/00* (2006.01)

(52) U.S. Cl. ..... 246/465

(58) Field of Classification Search ..... 246/454, 246/465, 466, 467

See application file for complete search history.

(56) References Cited

U.S. PATENT DOCUMENTS

| | | | | |
|---|---|---|---|---|
| 979,479 | A | 12/1910 | Elfborg | |
| 5,746,400 | A | 5/1998 | Remington et al. | |
| 6,971,610 | B2 * | 12/2005 | Hein et al. | 246/465 |

* cited by examiner

*Primary Examiner*—S. Joseph Morano
*Assistant Examiner*—Robert J McCarry, Jr.
(74) *Attorney, Agent, or Firm*—Bracewell & Giuliani

(57) ABSTRACT

A modular railway diamond crossing incorporates sets of acute and obtuse angle castings. The rail connections to the castings have a fine taper to minimize joint impacts. The castings are spaced apart with a combination of rails and cast blocks. The outside block is a tapered design that maintains the flangeway and holds the castings and rails together. The inside block comprises a tapered common center casting. This unit also maintains the flangeway and a longitudinal distance between the castings. The center casting is a common part to all such crossings regardless of the crossing angle.

4 Claims, 6 Drawing Sheets

RAILWAY DIAMOND CROSSING

BACKGROUND OF THE INVENTION

1. Technical Field

The present invention relates in general to an improved railway crossing and, in particular, to an improved railway diamond crossing with a reversible common insert. The crossing also includes a taper joint construction to minimize wheel impacts at the casting-to-rail interface. The taper joint connection is differs from the prior art as the casting design allows for the castings to be easily machined.

2. Description of the Related Art

Railway crossings, generally referred to as diamond crossings, occur where one railway line crosses over another. At the present time most railway crossings have to be individually designed because the crossing angles vary from one crossing to another. It has been found that, in general, very few crossings have the same crossing angle. This means that each and every crossing has to be custom designed and custom made.

Railway crossings wear faster than continuous railway lines due to train wheels impacting at the crossing points. This generally results in the crossings having to be replaced or repaired frequently. As these crossings are custom designed, in other words are non-standard, then the costs of replacing or repairing crossing members are high.

There are two crossing designs commonly used today that feature reversible castings. One is similar to U.S. Pat. No. 2,003,398 to Strong, which is generally depicted in the AREMA plan No. 747. More recently, U.S. Pat. No. 5,746,400 to Remington, also has been used. The reversible feature is related to the castings and center connecting rails.

As the crossing angle changes, the distance between intersections increases. Typically, these designs are connected with rail sections that are either bent or straight, and while reversible within the limits of any one given crossing, the lengths of these rails are dependent on the angle of the crossing. The length of the casting arms where the rails are attached is subject to a designer's interpretation and as such, a crossing of the same angle designed by more than one engineer or company can have connecting rails with different lengths. This causes a significant issue when it is time to replace the crossing since each design is unique. Both of the aforementioned solutions have a mitered rail connection to the casting that utilizes the full head of the rail. While a mitered joint is deemed more desirable than a square butt joint, there is an impact at the transition. Hence, although these designs are workable an improved solution would be desirable.

SUMMARY OF THE INVENTION

The features of modular-style corner castings may be utilized with a reduced-width joint connection that greatly minimizes impact at the rail and casting connections. The design of the casting allows for fully machined rail fits. While bending and machining rails that are connected to the outer arms adds some labor, the benefits of reducing joint impacts offsets this requirement. Reducing joint impacts reduces material flow, bolt loosening, and surface deformation. The reduction of these disadvantages increases the life of the crossing. The common center replacement casting or forging can be used on any crossing angle utilizing this design. Thus, a common casting may be warehoused until needed, which greatly reduces the duration of the replacement process.

One embodiment of a system, method, and apparatus for a modular railway diamond crossing is disclosed. The design incorporates acute and obtuse angle castings (e.g., four each) that may vary from approximately 40° to 90°. The rail connections to the castings have a fine taper to minimize joint impacts. The castings are spaced apart with a combination of rails and/or cast blocks. The outside block is a tapered design that maintains the flangeway and holds the castings and rails together. The inside block comprises a tapered common center casting. This unit also maintains the flangeway and a longitudinal distance between the castings. The center casting is a common part to all such crossings regardless of the crossing angle. The use of common center castings significantly reduces inventory and maintenance issues. As with all crossings, this design is dependent on the type of rail section utilized and may be readily adapted for all types known in the art.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention, which will become apparent, are attained and can be understood in more detail, more particular description of the invention briefly summarized above may be had by reference to the embodiments thereof that are illustrated in the appended drawings which form a part of this specification. It is to be noted, however, that the drawings illustrate only some embodiments of the invention and therefore are not to be considered limiting of its scope as the invention may admit to other equally effective embodiments.

DETAILED DESCRIPTION OF THE INVENTION

Figure 1:
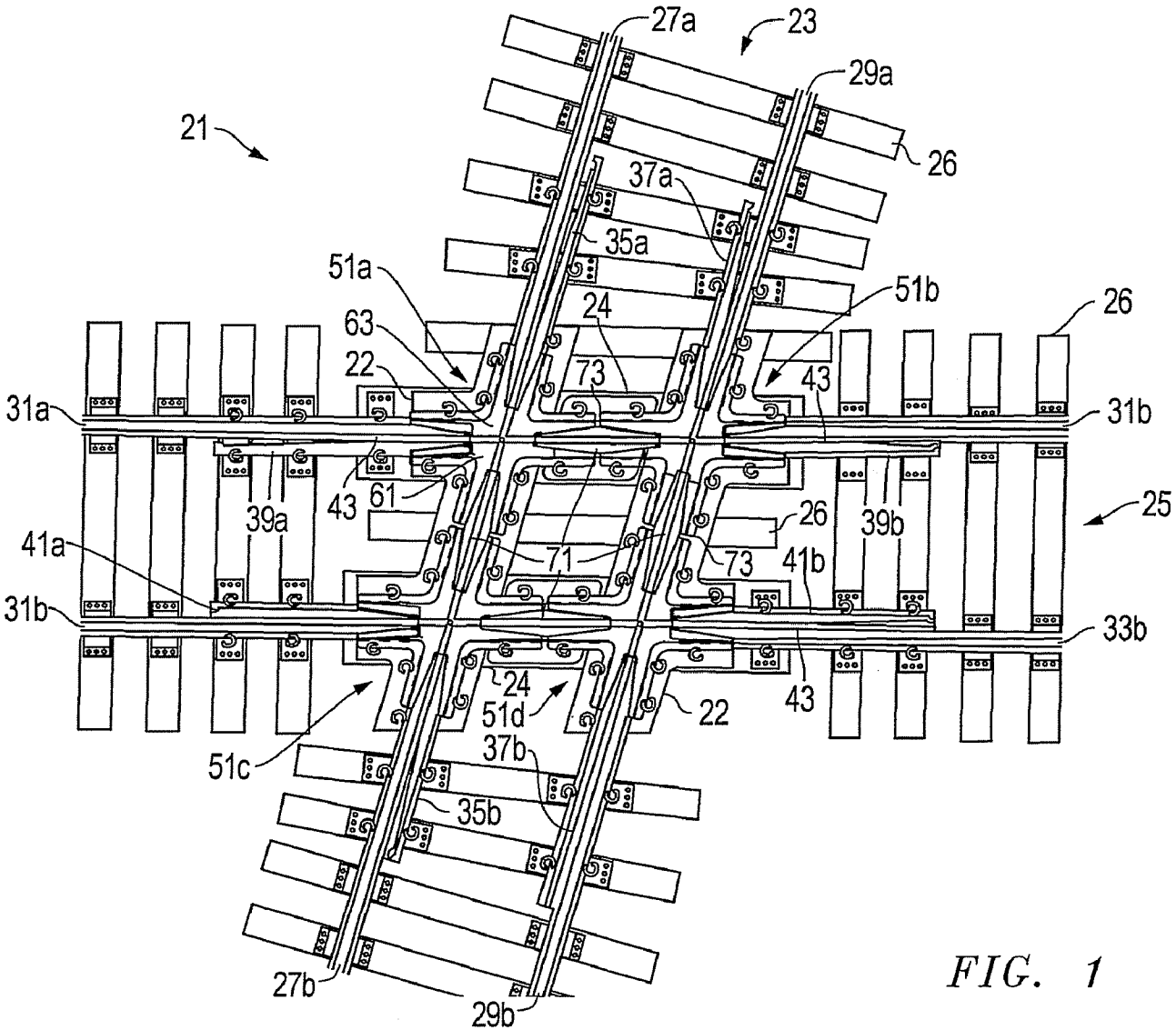
FIG. 1 is a plan view of one embodiment of a railway crossing constructed in accordance with the invention.
Figure 2:
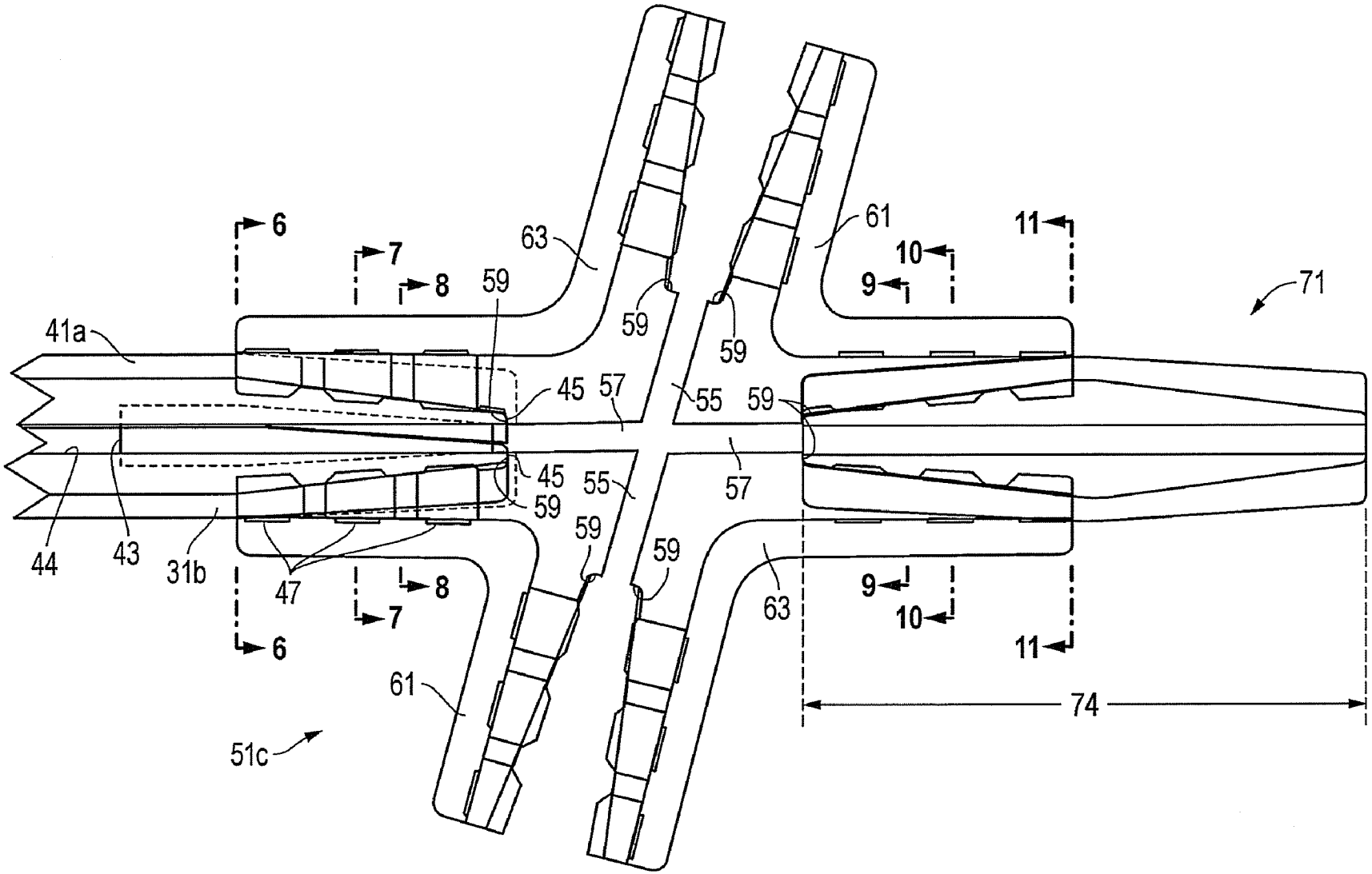
FIG. 2 is an enlarged plan view of a lower left portion of the railway crossing of FIG. 1 and is constructed in accordance with the invention.

Referring to FIGS. 1-11, one embodiment of a system, method and apparatus for a railway crossing or diamond crossing for railroad cars is shown. As shown in FIG. 1, railway crossing 21 may be mounted on plates 22, 24 and allows two sets of railroad tracks 23, 25 to cross each other. Plates 22, 24 and tracks 23, 25 are mounted on ties 26 or assemblies of ties 26. Track 23 includes two sets of rails 27*a, b* and 29*a, b*, and track 25 includes two sets of rails 31*a, b* and 33*a, b*.

As shown in FIGS. 1, 2, and 6-8, each rail 27, 29, 31, 33 is combined with a guard rail 35, 37, 39, 41, respectively, and a wedge or tapered flangeway block 43 for engaging the railway crossing 21. Each tapered flangeway block 43 may have a length of approximately 18-inches. The rails, guard rails, and tapered flangeway block combine to define a flangeway 44.

In one embodiment (see FIG. 2), each of the rails and guard rails is tapered to a fine shoulder 45. Shoulder 45 is approximately ⅝ to ¾-inches wide in the transverse horizontal direction (relative to the direction of the rails) as shown in the plan view. These components and railway crossing 21 are secured to each other with a plurality of bolts 47 (e.g., three shown) that extend through coaxial holes.

Again referring to FIGS. 1 and 2, railway crossing 21 comprises a plurality of "corner groups" 51 (e.g., four shown in FIG. 1; one of which is shown in FIG. 2). Each corner group 51 has a flangeway crossing to define a plurality of flangeways 55, 57 (e.g., two shown in FIG. 2). Each of the corner groups 51 is tapered along each flangeway 55, 57 in the directions of the rails to form rail shoulders 59 to minimize joint impacts. For example, rail shoulders 59 are complementary to and engage shoulders 45 on the rails.

In the embodiment shown, each of the four corner groups 51 includes a pair of acute angle blocks 61 and a pair of obtuse angle blocks 63 (e.g., for a total of eight each). Acute and obtuse angle blocks 61, 63 may be formed as castings and are shaped at complementary acute and obtuse angles, respectively, when observed in plan view (e.g., FIGS. 1 and 2). The acute angle may be configured in a range of approximately 40° to 90°. The acute and obtuse angle blocks 61, 63 are configured around each corner group 51 in an alternating fashion, such that the acute angle blocks 61 are opposite each other, as are the obtuse angle blocks 63. The acute and obtuse angle blocks maintain flangeways 55, 57 with rail flangeways 44.

Figure 3:
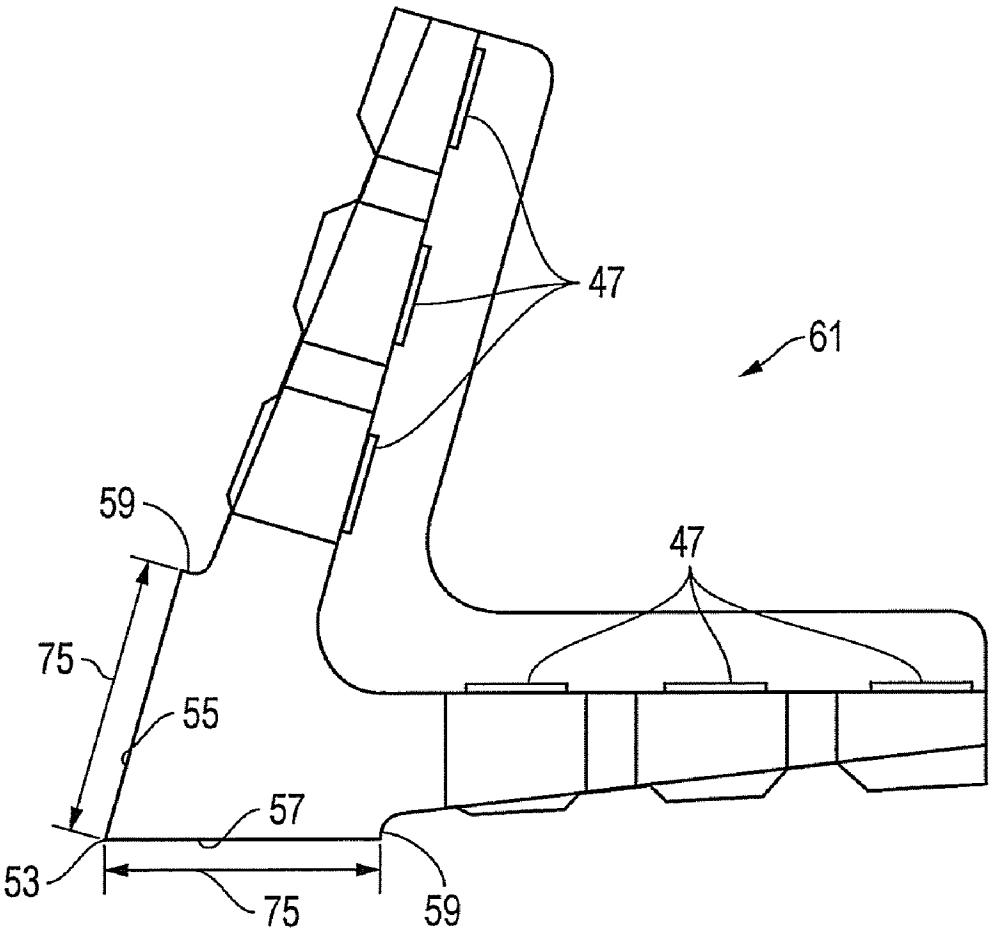
FIG. 3 is an enlarged plan view of one embodiment of an acute angle block in the railway crossing of FIG. 1 and is constructed in accordance with the invention.
Figure 4:
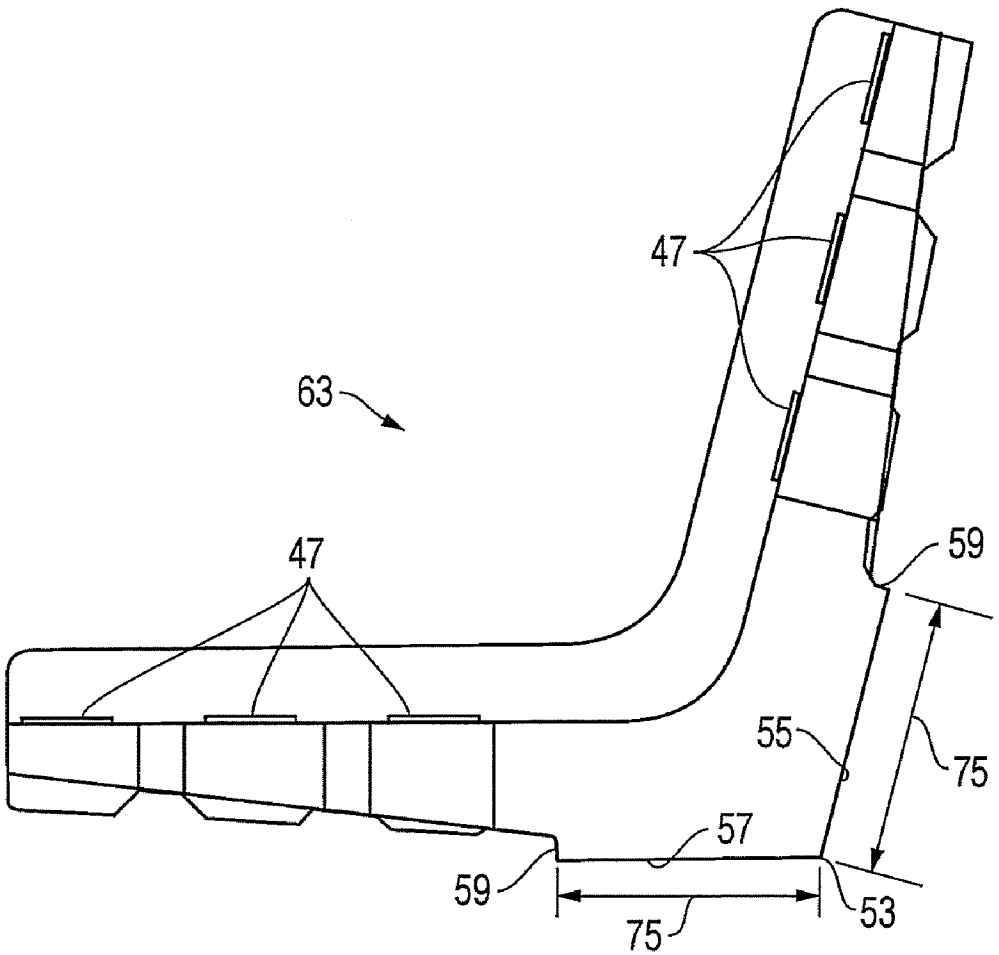
FIG. 4 is an enlarged plan view of one embodiment of an obtuse angle block in the railway crossing of FIG. 1 and is constructed in accordance with the invention.
Figure 5:
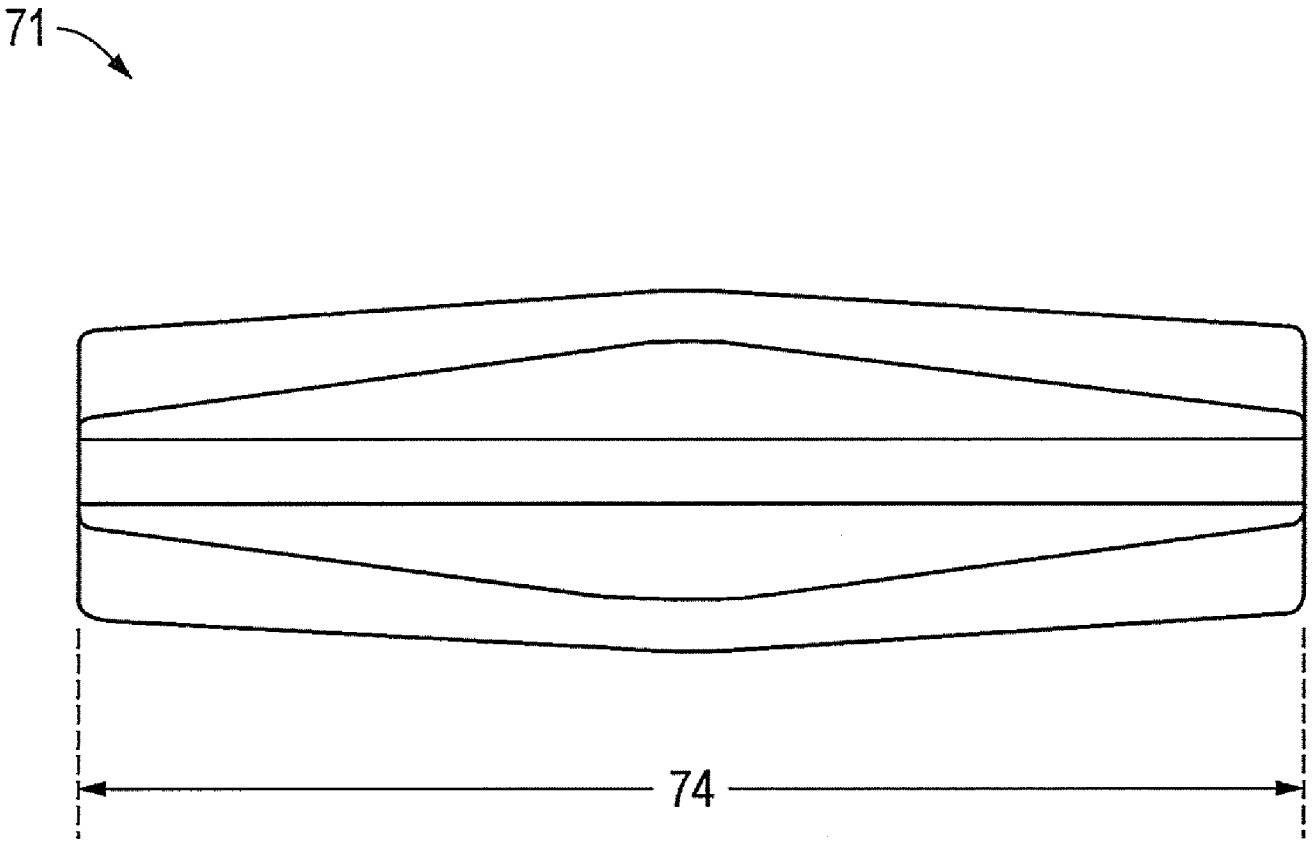
FIG. 5 is an enlarged plan view of one embodiment of a center block in the railway crossing of FIG. 1 and is constructed in accordance with the invention.
Figure 6:
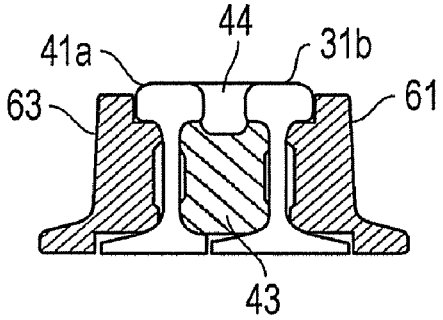
FIG. 6 is an enlarged sectional view of the railway crossing of FIG. 1 taken along the line 6-6 of FIG. 2 and is constructed in accordance with the invention.
Figure 9:
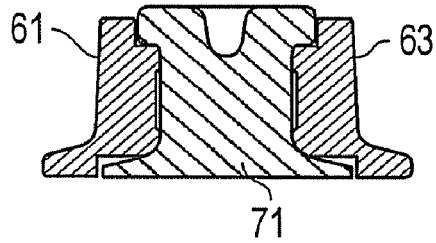
FIG. 9 is an enlarged sectional view of the railway crossing of FIG. 1 taken along the line 9-9 of FIG. 2 and is constructed in accordance with the invention.
Figure 7:
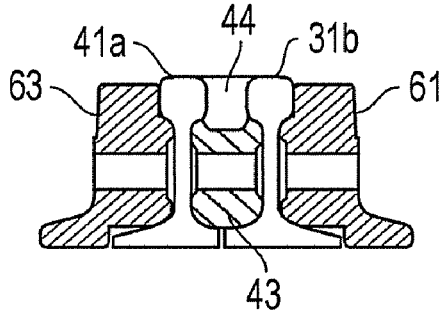
FIG. 7 is an enlarged sectional view of the railway crossing of FIG. 1 taken along the line 7-7 of FIG. 2 and is constructed in accordance with the invention.
Figure 10:
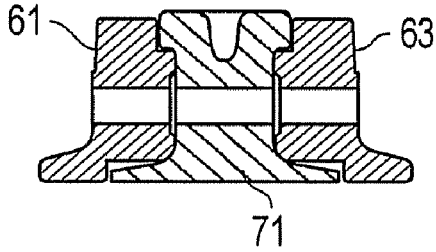
FIG. 10 is an enlarged sectional view of the railway crossing of FIG. 1 taken along the line 10-10 of FIG. 2 and is constructed in accordance with the invention.
Figure 8:
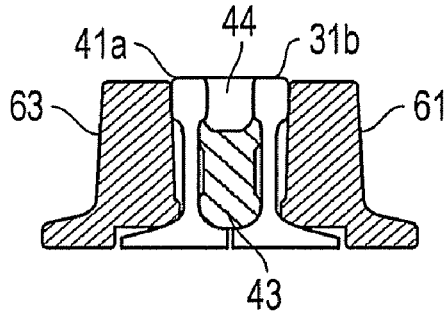
FIG. 8 is an enlarged sectional view of the railway crossing of FIG. 1 taken along the line 8-8 of FIG. 2 and is constructed in accordance with the invention.
Figure 11:
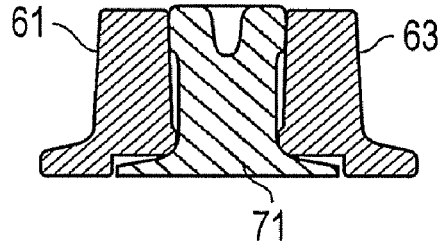
FIG. 11 is an enlarged sectional view of the railway crossing of FIG. 1 taken along the line 11-11 of FIG. 2 and is constructed in accordance with the invention.

As described above, each corner group 51 has rail shoulders 59 (e.g., eight per group). As shown in FIGS. 3 and 4, there are two rail shoulders 59 formed on each acute and obtuse angle block 61, 63, respectively. Accordingly, each of the acute and obtuse angle blocks 61, 63 is tapered in respective rail directions to form the rail shoulder 59, each of which has a width of approximately ⅝ to ¾-inches in directions transverse to the respective rail directions to minimize joint impacts.

Referring now to FIGS. 1, 2, 5, and 9-11, the railway crossing 21 also comprises a plurality of center blocks or inserts 71 (e.g., four shown in FIG. 1). Each center block 71 is located between and configured to accommodate an adjacent pair of the corner groups 51 directly between their respective pairs of acute and obtuse angle blocks 61, 63. The inserts 71 are used exclusively to separate the corner groups 51 from each other by a small distance 73. The four center blocks 71 share identical dimensions (e.g., length 74 in the respective rail directions) regardless of a crossing angle of the railway crossing 21.

In one embodiment, the length 74 (FIG. 2) of each center block 71 is approximately 37.25-inches. Like the acute and obtuse angle blocks 61, 63, the center blocks 71 may be formed as castings. As shown in FIGS. 3 and 4, each of the acute and obtuse angle blocks 61, 63 has an arm length 75 (each of which may be unique) that is defined from the crossing or intersection 53 of the flangeways to one of the rail shoulders 59. Arm lengths 75 are defined by the length 74 of the center block 71, which again is the same for each center block 71.

While the invention has been shown or described in only some of its forms, it should be apparent to those skilled in the art that it is not so limited, but is susceptible to various changes without departing from the scope of the invention.

What is claimed is:

1. A railway crossing, comprising:

eight acute angle castings, each formed at an acute angle;

eight obtuse angle castings, each formed at an obtuse angle that is complementary to the acute angle;

the acute and obtuse angle castings being configured in four corner groups, with each corner group comprising two of the acute angle castings and two of the obtuse angle castings, such that said two of the acute angle castings are opposed and said two of the obtuse angle castings are opposed in respective ones of the four corner groups to define two flangeways located between adjacent ones of the acute and obtuse angle castings in each corner group; and four center castings, each of which is located between an adjacent pair of the four corner groups to separate the four corner groups in respective rail directions, and the four center castings share identical dimensions regardless of a crossing angle of the railway crossing.

2. A railway crossing according to claim 1, wherein the acute angle is in a range of approximately 40° to 90°.

3. A railway crossing according to claim 1, wherein each of the acute and obtuse angle castings is tapered in respective rail directions to form rail shoulders, each having a width of approximately ⅝-inches in a direction transverse to the respective rail directions to minimize joint impacts.

4. A railway crossing according to claim 3, wherein each of the acute and obtuse angle castings has a casting arm length that extends from an intersection of the flangeways to respective ones of the rail shoulders, and each casting arm length is defined by a length of one of the center castings.

* * * * *